US005896704A

United States Patent [19]

Neag et al.

[11] Patent Number: 5,896,704

[45] Date of Patent: Apr. 27, 1999

[54] TRACK ARRANGEMENT FOR VEHICLE SLIDING DOOR

[75] Inventors: Dorinel Neag, Commerce Township; Michael Abney, Southfield; Thomas Carbone, Grosse Pointe; Keith DeRiso, Southfield, all of Mich.

[73] Assignee: DaimlerChrysler Corporation, Auburn Hills, Mich.

[21] Appl. No.: 08/699,285

[22] Filed: Aug. 19, 1996

[51] Int. Cl.[6] ..... E05D 15/10

[52] U.S. Cl. ..... 49/209; 49/223; 296/155

[58] Field of Search ..... 49/209, 211, 216, 49/218, 221, 223, 225, 360; 296/146.12, 155

[56] References Cited

U.S. PATENT DOCUMENTS

| | | | |
|---|---|---|---|
| 1,928,523 | 9/1933 | Bally . | |
| 2,900,207 | 8/1959 | May . | |
| 3,051,999 | 9/1962 | Schimek . | |
| 3,075,803 | 1/1963 | Wilfert . | |
| 3,312,015 | 4/1967 | Plegat . | |
| 3,605,338 | 9/1971 | Grossbach | 49/221 X |
| 3,935,674 | 2/1976 | Williams et al. . | |
| 4,019,775 | 4/1977 | Grossbach et al. | 49/218 X |
| 4,110,934 | 9/1978 | Zens | 49/223 X |
| 4,152,872 | 5/1979 | Tanizaki et al. | 49/223 X |
| 4,157,846 | 6/1979 | Whitcroft | 49/209 X |
| 4,268,996 | 5/1981 | Allen . | |
| 4,495,729 | 1/1985 | Britzke et al. . | |
| 4,617,756 | 10/1986 | Dilcher . | |
| 4,869,544 | 9/1989 | Anwyll et al. | 49/221 X |

*Primary Examiner*—Milton Nelson, Jr.
*Attorney, Agent, or Firm*—William J. Coughlin

[57] ABSTRACT

An arrangement for mounting a sliding door to a vehicle body for movement between an open position and a closed position. The arrangement includes a guide track mounted to the sliding door, a carriage support arrangement carried by the sliding door and a swing arm. The swing arm is connected to the carriage for pivotal movement about a first axis and to the body for pivotal movement about a second axis. With the sliding door unlatched, the swing-arm rotates the carriage support arrangement and the sliding door through an obtuse swing angle, thereby reducing longitudinal tipping forces on the sliding door. Further, when the swing-arm and sliding door are in the full-open position, the sliding door's center of gravity is only slightly offset aft of the carriage support arrangement, thereby reducing the force needed to remove the swing-arm, carriage support arrangement and vehicle sliding door to a fully-closed position.

20 Claims, 5 Drawing Sheets

TRACK ARRANGEMENT FOR VEHICLE SLIDING DOOR

FIELD OF THE INVENTION

This invention relates to vehicle sliding doors and, more particularly, to a swing-arm and carriage support arrangement for a vehicle sliding door having a track mounted on the inside of the door.

BACKGROUND OF THE INVENTION

It is known in the art relating to vehicle sliding doors to provide a middle track on the inside of the door to improve the exterior lines of the vehicle. It is also known to use a pair of swing-arms to pivot the door out of the door panel in the manner of a four bar parallelogram linkage. One sliding door arrangement discloses a single swing-arm having its one end pivoted to a body pillar and its other end pivoted to a carriage sleeve slidably supported on a longitudinal bar fastened on the inside of the door, for resisting the entire weight of the door. The swing-arm, which is limited to ninety degrees of rotational travel, has a rigid guide arm, fixed at the swing-arm other end, and includes a guide roller on its free end that travels in a curved end of a stationary body guide rail at the door bottom edge.

SUMMARY OF THE INVENTION

The present invention provides a swing-arm and roller carriage arrangement for a middle track mounted on the inside of a vehicle sliding door. The door has guide rollers situated at upper and lower front corners of the door adapted for cooperation with associated upper and lower guiding tracks extending along the vehicle body above and below the door opening. The swing-arm, pivoted to a body rear edge pillar of the door opening, rotates the carriage and door outboard and rearwardly, through a predetermined obtuse angle, to an intermediate door open position, wherein carriage roller means, supporting the weight of the door, are located aft of the opening rear edge pillar. As a result, upon the door being moved longitudinally on the roller means to its full-open position, the door's center of gravity is displaced a dimension of the order of about 78 mm aft of a transversely extending pin that rotatably supports the roller means on the carriage. As the support pin transfers the weight of the full-open door from the carriage to the swing-arm, the small aft displacement of the support pin from the center of gravity minimizes loading moments about the pin tending to longitudinally tip the door. Further, the small aft displacement of the support pin results in a relatively large longitudinal offset between the carriage roller means transverse pin and the door's upper and lower front guide rollers, thereby providing increased stability of the door in its full-open position.

It is another feature of the present invention to provide the sliding door swing-arm with a trough-plate shape, when viewed in plan, including a longitudinally extending bight section terminating in front and rear oppositely diverging legs, with its front leg free end in the form of leg-half hinge knuckles, pivoted by a vertical carriage pin, to a carriage-half hinge knuckle, and its rear leg in the form of leg-half hinge knuckles, pivoted by a vertical body pin, to body-half hinge knuckles mounted adjacent an aft vertical edge of the door opening, wherein, in the door closed position, the bight section is offset inboard providing packaging space for portions of the carriage.

It is still another feature of the invention wherein the swing-arm trough-plate shape, with the door in its closed position, has its longitudinal bight section offset inboard and terminating in front and rear oppositely diverging legs, enabling the swing-arm to be rotated through an obtuse angle of the order of 124 degrees, by virtue of the swing-arm bight section and rear legs clearing body structure adjacent the aft edge of the door opening.

It is yet another feature of the invention to provide a swing-arm and carriage sliding door supporting arrangement, wherein a first carriage latch, pivoted adjacent its midpoint, has a hook on one end resiliently biased into locking engagement with a striker on the inside of the door when the door is in its closed position. The engaged first carriage hook prevents the door from sliding on the carriage roller means during rotation of the swing-arm and door from their door closed position to a door intermediate-open position. The other end of the first carriage latch has an arcuate ramp biased into contact with a cylindrical collar, concentrically surrounding the carriage pivot pin and fixed on the upper end of a leg-half hinge knuckle for rotation therewith. An arcuate ramp edge on the other end of the first carriage latch is resiliently biased into contact with the collar cylindrical surface. As the door approaches its intermediate-open position the first carriage latch ramp portion is rotated, against its bias, by an arcuate cam portion of a cam-hook formed on the collar cylindrical surface, disengaging the first carriage latch hook from its striker and allowing the door to slide rearwardly on the carriage roller means to its full-open position.

It is a still further feature of the invention to provide a rotatable swing-arm latch that acts between the swing-arm and the carriage, wherein the swing-arm latch includes a hook resiliently biased into engagement with an outboard surface of the carriage that extends forward of its carriage hinge pin, such that a surface of the swing-arm front leg is urged into flush abutment with an opposed inboard surface of the carriage, whereby the engaged swing-arm latch operates to rigidify the swing-arm and carriage, thereby providing lateral stability to the door as it travels longitudinally on the carriage roller means.

It is another feature of the invention wherein, during forward closing movement of the door on the carriage roller means a beveled check, formed on a check plate secured on the inside of the door, cams the swing-arm latch hook to its disengaged position, allowing the door to swing inboard through a predetermined acute angle, until a hook of a second carriage rotational latch is biased into engagement with the hook portion of the cam-hook. The engaged cam-hook allows limited door and swing-arm inboard swinging, after which the second carriage latch hook disengages the cam hook, while the first carriage latch ramp edge rides off the cam portion of the cam-hook and biases the first carriage latch hook into engagement with the door striker, upon the swing-arm rotating the door to its closed position.

These and other features and advantages of the invention will be more fully understood from the following detailed description of the invention taken together with the accompanying drawings.

DETAILED DESCRIPTION OF THE INVENTION

Figure 1:
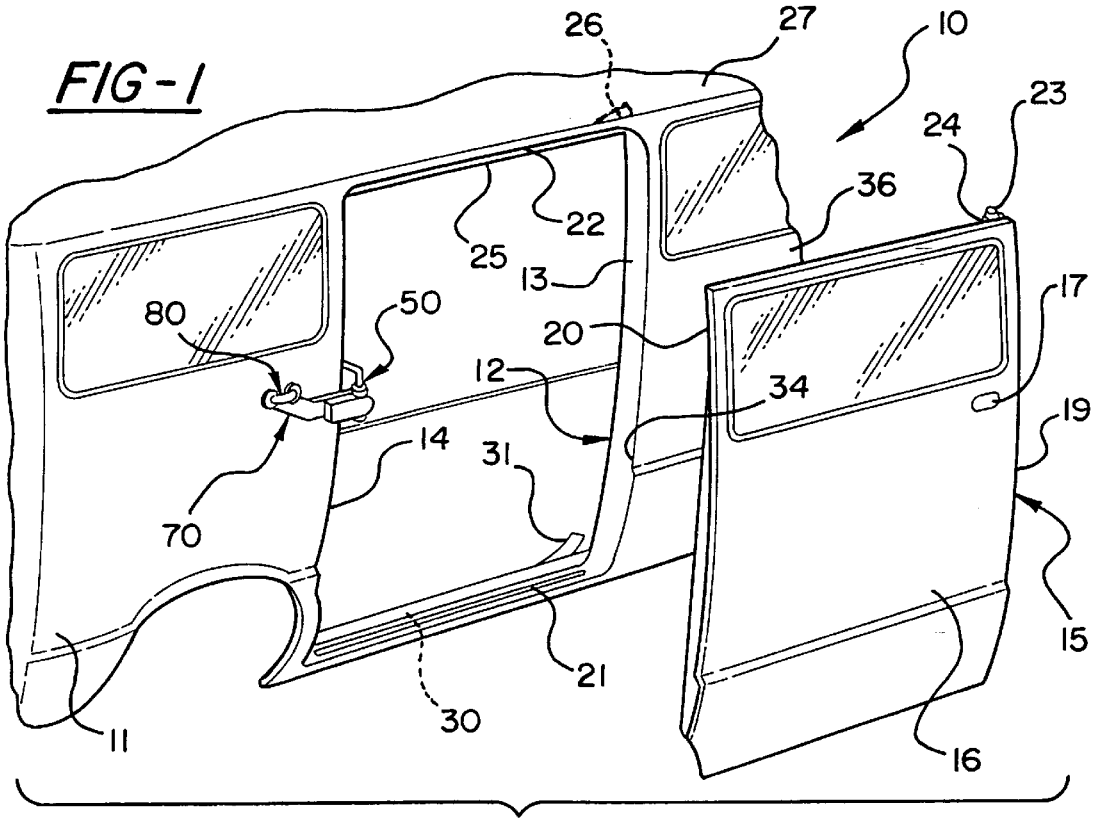
FIG. 1 is a fragmentary, exploded, perspective, exterior view of a van type vehicle body, showing a side door opening together with a swingable sliding door for closing the opening, in accordance with the present invention.

Referring now to the drawings in detail, numeral 10 in FIG. 1 generally indicates an exploded perspective view of a van-type vehicle body with a right side exterior panel 11 provided with a side doorway opening 12, defined at its forward edge by a front body pillar 13 and at its rearward edge by an aft body pillar 14. A sliding side panel door 15, shown in FIG. 2 closing the side opening 12, includes an exterior door panel 16, supporting an outer handle 17, and an interior door panel 18, with the panels joined to define forward 19 and aft 20 vertical edges. FIG. 1 shows the door opening 12 further defined by a body lower sill step 21 and an upper roof panel edge 22.

Figure 2:
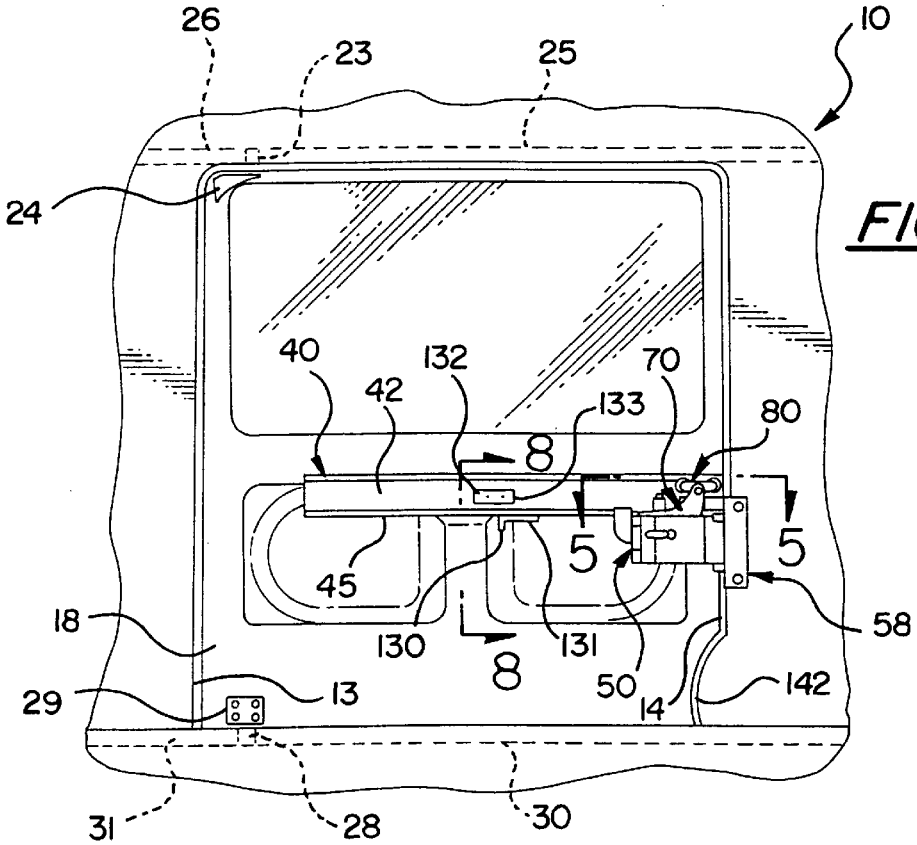
FIG. 2 is an enlarged, fragmentary, interior side view of the sliding door of FIG. 1, with the door shown in its closed position.

With reference to FIG. 2, the door 15 is slidably supported by an upper front guide roller 23, mounted on the interior panel 18 by an upper bracket 24, secured adjacent an upper forward corner of the inner panel 18. The guide roller 23 travels longitudinally in an upper channel-shaped track 25, terminating at its forward end in a conventional inwardly curved section 26, fixed to an underside of body roof panel 27. A lower front guide roller 28 is mounted by bracket 29 adjacent a lower forward corner of the inner panel 18. The lower guide roller 28 travels longitudinally in a lower track 30, fixed on the body sill step 21, and terminates at its forward end in a inwardly curved lower track section 31. The conventional forward upper 26 and lower 31 curved track sections allow door 15 to move from its open position, held suspended parallel to and adjacent right side panel 11, to its closed position of FIG. 2, wherein the sliding door leading edge 19 is brought towards a trailing edge 34 of right side front door 36. Thereafter, the sliding door outer panel 16 is positioned flush with the front door 36 and into sealing engagement with a sliding door seal, not shown, surrounding the door opening 12.

With reference to FIG. 2, a middle track 40 is shown supported on the interior door panel 18, adjacent the door's vertical midpoint, intermediate the upper 25 and lower 30 body mounted tracks. The middle track 40, shown in FIG. 8 formed with a generally C-shaped vertical cross section, includes a vertical base plate 42 fixed, as by welding, to the door interior panel 18. The base plate 42 is formed with upper 44 and lower 45 horizontally disposed, inboard extending, extensions, coextensive with the middle track 40. The upper extension 44 terminates in downstanding upper guide flange 46, while the lower extension 45 terminates in upstanding lower guide flange 47, wherein the upper 46 and lower 47 flanges define a common vertical plane.

Figure 5:
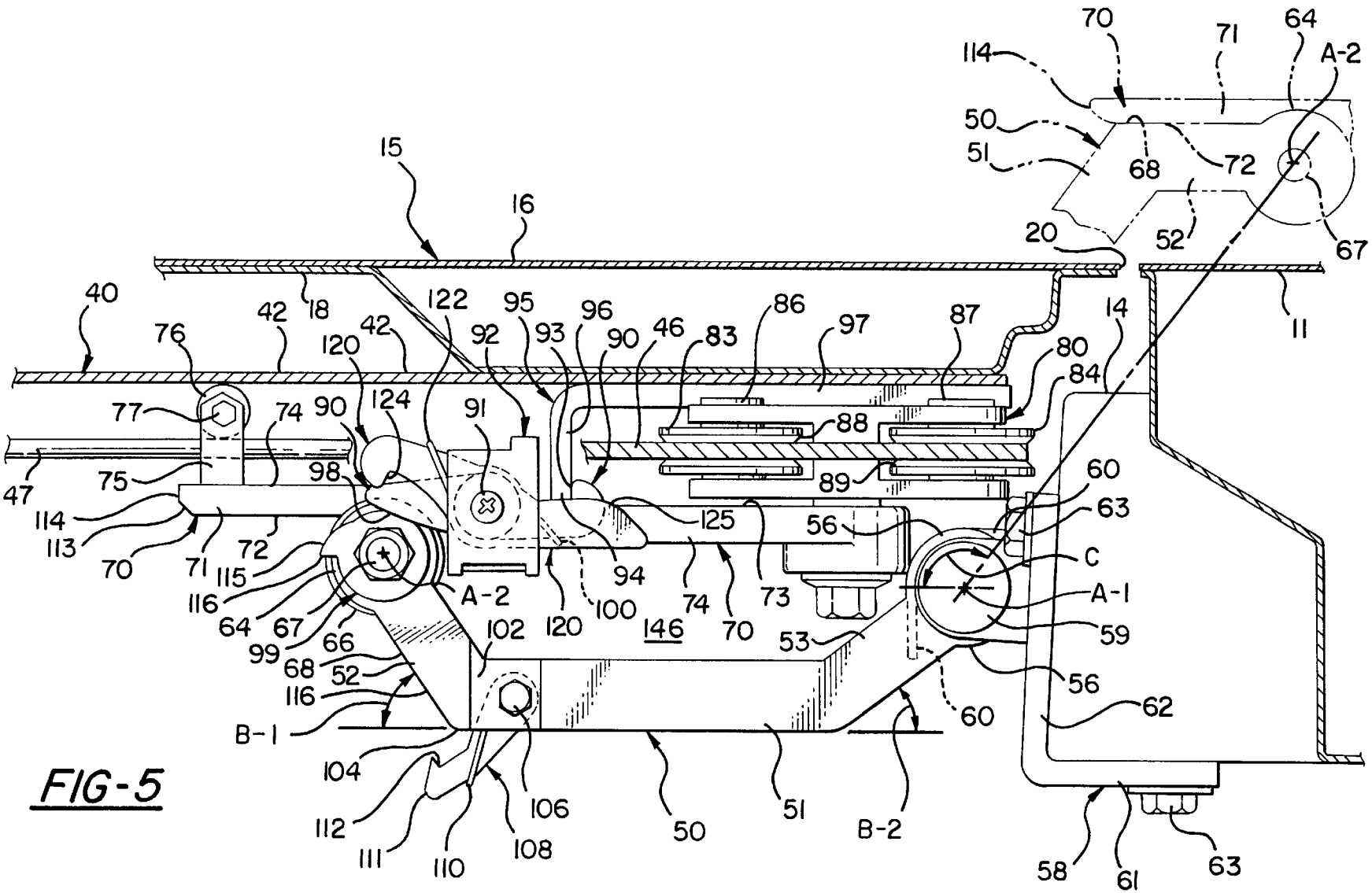
FIG. 5 is an enlarged, fragmentary, horizontal sectional view, taken substantially on the line 5—5 of FIG. 2, showing the central hinge swing arm and carriage mechanism, hinged to the doorway aft pillar, with the sliding door in its closed position.

As seen in FIG. 5, a plan view of swing-arm 50, in its door closed position, defines a generally trough-plate shape, including a longitudinally extending bight section 51 formed with opposite front 52 and rear 53 outboard diverging, asymmetrical legs. The free end of swing-arm rear leg 53 is formed with integral upper 54 and lower 55 rear leg-half hinge knuckles having aligned holes, not shown, aligned with holes of associated upper 56 and lower 57 rear body-half hinge knuckles of an aft body hinge bracket 58, receiving a vertical body hinge pin 59. FIG. 5 shows a wire coil torsion spring 60, encircled about body hinge pin 59, and having its one end anchored to the swing-arm rear leg 53 and its other end anchored to body hinge bracket 58. The torsion spring 60 operates to resiliently bias the swing-arm 50 in a first clockwise rotational direction about axis "A-1" of the body hinge pin 59.

The hinge bracket 58, defined by a substantially right-angle cross-section, includes longitudinal 61 and transverse 62 flanges suitably secured to associated surfaces of the aft pillar 14, as by bolts 63. The swing-arm front leg 52, which diverges forwardly and outboard from the bight section 51, defines an external acute angle "B-1" of about 55 degrees with bight section 51, while the swing arm rear leg 53, which diverges rearwardly and outboard from the bight section 51, defines an external acute angle "B-2" of about 35 degrees with the bight section.

Figure 4:
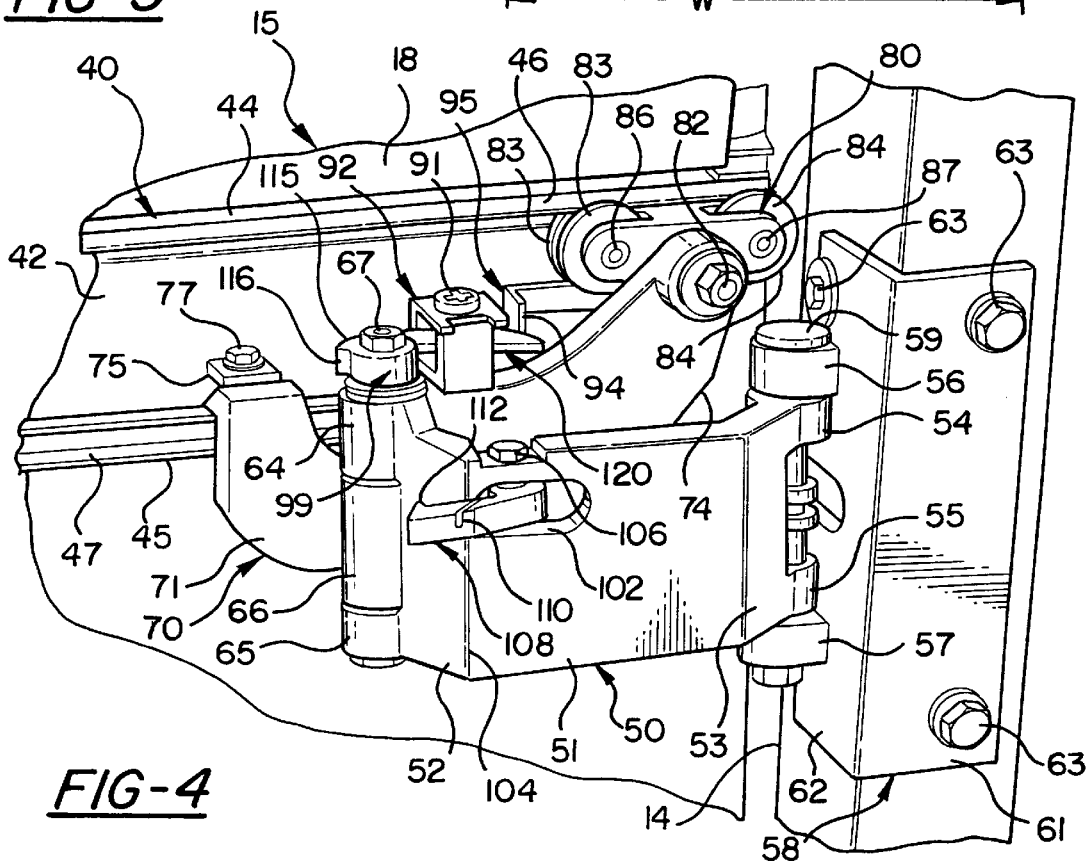
FIG. 4 is an enlarged, fragmentary, perspective view of the sliding door swing arm, hinged to an aft door opening pillar bracket.

Referring to FIG. 4, the swing-arm forward leg 52 has its free end formed with upper 64 and lower 65 front leg-half hinge knuckles provided with through holes, not shown, aligned with a through hole of a center carriage-half hinge knuckle 66, so as to receive a vertical carriage hinge pin 67. The carriage-half hinge knuckle 66 is secured to and extends inboard from a longitudinally extending carriage, generally indicated at 70. The torsion spring 60 urges the swing-arm outboard through an obtuse angle of about 124 degrees, shown by angle "C" in FIG. 5, wherein the swing-arm aft rotation is stopped by the hinge bracket 58. It will be noted in FIG. 5 that the obtuse angle "C" is defined by the rotation of carriage pivot pin axis "A-2", about body pivot pin axis A-1, from an inboard, door closed position to a dashed-line, full-aft position of pin 67.

Figure 8:
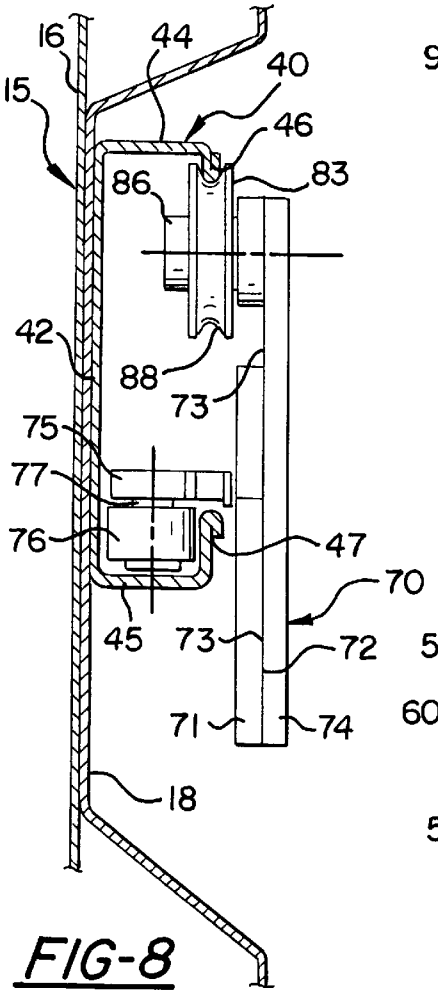
FIG. 8 is an enlarged vertical cross sectional view taken on the line 8—8 of FIG. 2.

As seen in FIGS. 5 and 8, the carriage 70 includes a forward longitudinal carriage plate 71, having an aft portion of its inboard face 72 secured, as by a welded lap-joint, to a forward face portion 73 of an aft longitudinal carriage plate 74. A forward carriage roller bracket 75, which extends outboard from surface 74 of the carriage forward plate 71, supports a carriage lateral load-bearing forward roller 76, pivoted on vertical roller pin 77. As viewed in FIG. 8, the forward roller 76 is movably retained within a lower channel, defined by the middle track base plate 42, lower extension 45, and upstanding guide flange 47.

With reference to FIG. 4, the carriage rearward and upwardly angled aft plate 72 pivotally supports an upper, longitudinally disposed, aft twin-wheel carriage hanger 80, pivoted about a transverse axis "A-3" of a hanger support pin 82, which transmits the weight of the open door from the carriage 70 to the swing-arm 50. The hanger 80 rotatably supports twin fore 83 and aft 84 tandem rollers, each rotatable about a transverse axis of associated fore 86 and aft 87 pivot pins, respectively. The roller pivot pins 86 and 87 are symmetrically disposed on either side of the hanger support pin axis "A-3", whereby the door weight is equally distributed to each of the rollers 83 and 84. As seen in FIG. 8, the forward 83 and aft 84 tandem rollers each has an associated peripheral groove 88 and 89, received for rolling travel along the upper guide flange 46 of the middle track 40.

With the door 15 in its closed position of FIG. 5, a first carriage latch 90 is rotationally supported, adjacent its midpoint, by a latch pivot pin 91 extending vertically through a horizontal portion of an open-ended, box-like bracket 92 mounted on the carriage. The first carriage latch 90 has a hook 93, formed adjacent its one aft end, adapted for locking engagement with a striker portion 94 of an L-shaped bar 95. The bar 95 includes a transverse right-angled foot 96 terminating in the striker 94, with the foot extending inboard from a longitudinal leg 97 suitably attached, as by welding, to an interior surface of the middle track base plate 42.

FIG. 5 shows the first carriage latch 90 formed with a convex, arcuate ramp edge 98, adjacent its opposite forward end, is resiliently biased into contact with a cylindrical-shaped collar 99 by a wire coil torsion spring 100, wrapped about the first carriage latch pin 91. It will be observed that with the door 18 in its closed position, the torsion spring 100 biases the first carriage latch hook 93 in a counter-clockwise rotational direction into locked engagement with the striker 94. The collar 99, which concentrically surrounds the upper end of the carriage hinge pin 66, is suitably fixed to swing-arm front leg-half hinge upper knuckle 64, so as to rotate therewith.

Figure 6:
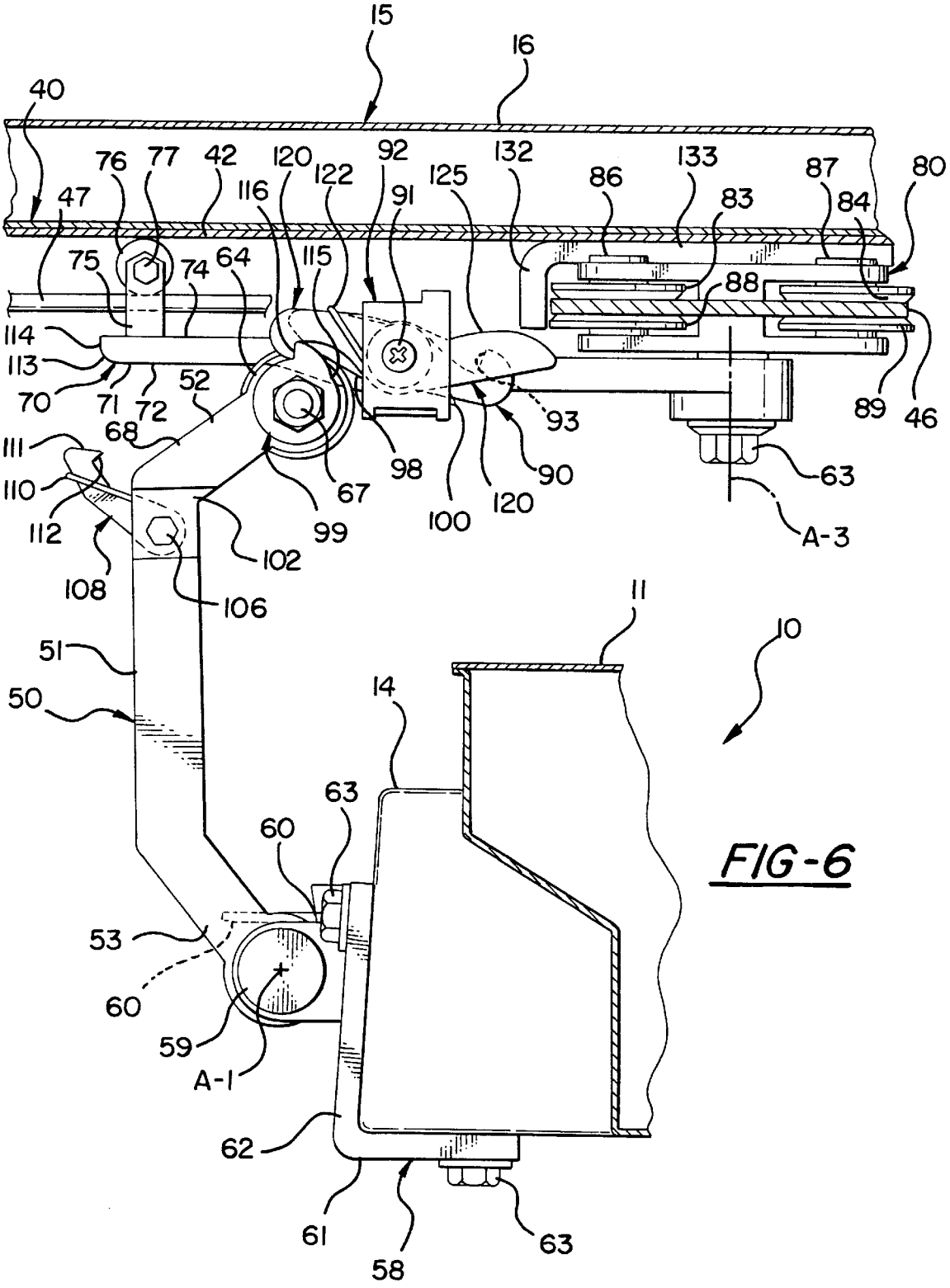
FIG. 6 is a view similar to FIG. 5, showing the swing-arm pivoted from its door closed position substantially 90 degrees counter-clockwise, wherein the door is at its maximum lateral outboard position.

In operation, upon a user initially pulling outward on the door handle 20, the swing-arm 50 is pivoted clockwise outboard about its body hinge pin axis "A-1", assisted by a resilient biasing force, imparted by the torsion spring 60 to the swing-arm. FIG. 6 shows the swing-arm 50 rotated laterally outboard, through an angle of the order of 90 degrees, about body hinge pin axis "A-1", from its FIG. 5 door closed position, to a door maximum outboard position.

Referring to FIG. 4, the swing-arm bight section 51 includes a through slot 102 having a forward radiused terminus adjacent vertical corner juncture 104. A vertical pivot pin 106 extends through the slot 102 with one end of a swing-arm latch 108 received in the slot 102. A coil torsion spring 110, encircling the pin 106, biases the swing-arm latch 108 in a counter-clockwise rotational direction. As the swing-arm latch 108 rotates to its maximum counter-clockwise position of FIG. 7, an angled face 111, formed on its end hook 112, rides-over a beveled corner 113 and lockingly engages forward end 114 of the carriage 70. It will be noted in FIG. 7 that the engaged swing-arm latch 108 clamps inboard surface 72, of the carriage forward plate 71, into flush contact with opposed, longitudinally coextensive surface 68 of the swing-arm forward leg 52, providing rigidity to the carriage hinge pin 67 connection. As a result with the swing-arm being rearwardly displaced a predetermined longitudinal dimension from the carriage forward free end 114, increased lateral stability is provided for the door 15 during its longitudinal fore and aft travel on the carriage twin rollers 83 and 84.

Figure 7:
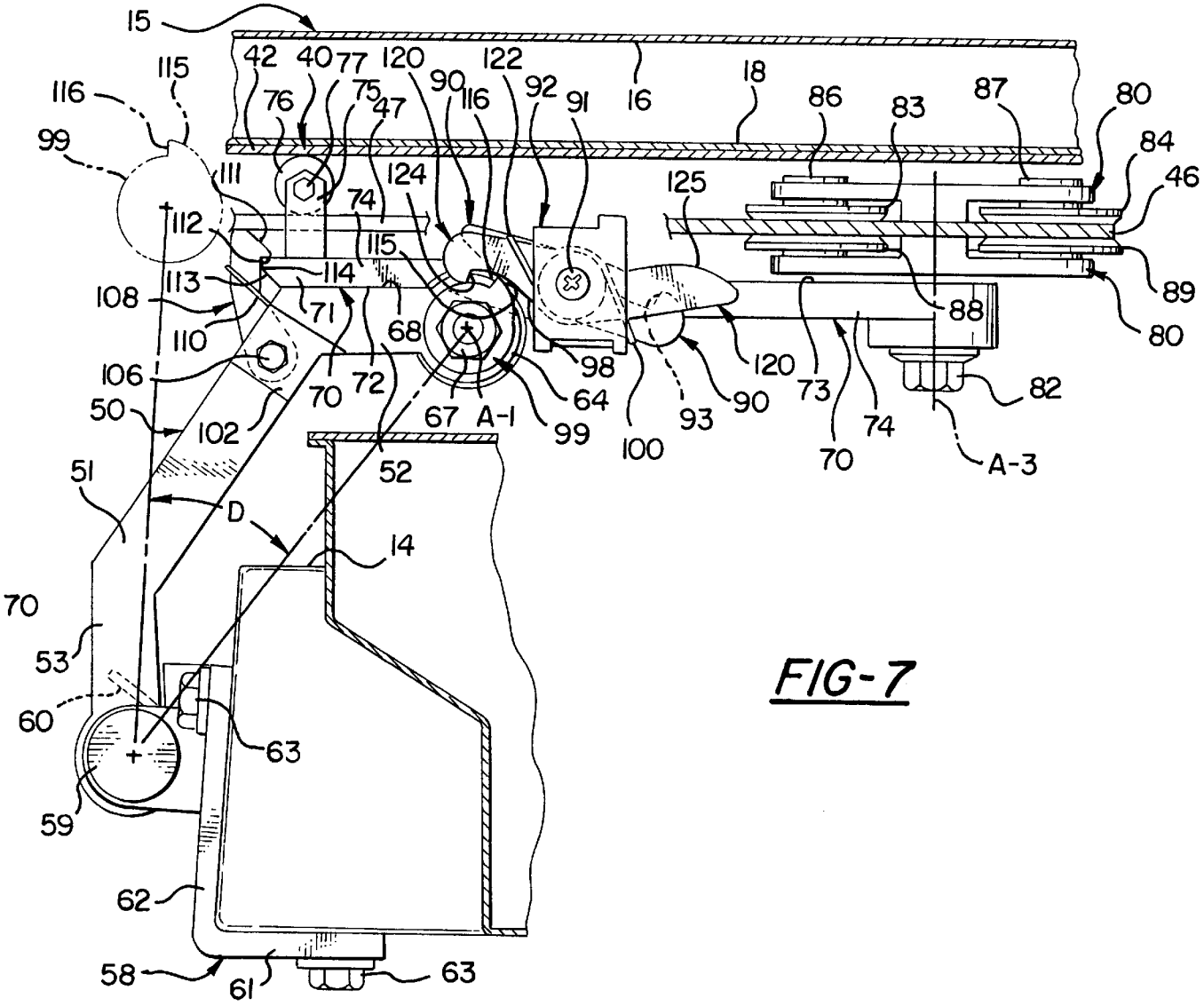
FIG. 7 is a view similar to FIG. 5, showing the swing-arm pivoted substantially 124 degrees from its door closed position to its door intermediate-open position, wherein the door has completed its outboard swinging movement, and is free for rearward longitudinal sliding travel to the door full-open position.

It will be further noted in FIG. 7 that as the swing-arm latch 108 lockingly engages the carriage forward edge 114, a convex cam 115, of a cam-hook 116 formed on the collar cylindrical-surface, is rotated into contact with edge ramp 98 of the first carriage latch 90. Upon the latch 90 being rotated clockwise, its hook 93 is moved from its latched to its unlatched position, releasing the striker 94, thereby allowing the door to slide rearwardly on the carriage twin rollers 83 and 84.

Referring to FIG. 5, a second carriage latch 120 is shown rotatably supported at an upper end on the pivot pin 91, above the first carriage latch 90. A torsion spring 122, wrapped about the pin 91, resiliently biases hook 124, on the second carriage latch one end, in a counter-clockwise direction, while an arcuate ramp edge 125, adjacent its opposite rear end, is resiliently biased into contact with the free end of striker 94. Upon the door being swung to its FIG. 6 position, the ramp edge is free of the striker 94 causing the second carriage latch hook 124 to be biased into contact with the cylindrical surface of the collar 99 as seen in FIG. 7.

As viewed in FIGS. 2 and 6, upon initial movement of the door 15 a predetermined dimension in a forward closing direction, a check 130, formed on a check bar 131 secured to the underside of middle track lower extension 45, cams the swing-arm latch 108 clockwise against its spring bias, disengaging the swing-arm latch hook 112. This allows the swing-arm 50 to be rotated through a predetermined acute angle, of the order of 34 degrees, shown by angle "D" in FIG. 7, causing the collar cam-hook 116 to be rotated clockwise, engaging the second carriage latch hook 124. The engaged latch hook 124 allows limited door and swing-arm inboard swinging, after which a check 132, formed on a check bar 133 secured to the middle track base plate 42, shown in FIG. 2, disengages the cam-hook 116. During the second carriage latch hook 124 disengagement, the first carriage latch ramp edge 98 rides off the cam 115 of the clockwise rotating cam-hook, resiliently biasing the first carriage latch hook 93 into locked engagement with the striker 94, thereby allowing the swing-arm 50 to rotate the door 15 to its closed position. It will be noted that in the event of partial opening of the door, check 130 prevents the swing-arm latch 108 from rotating into locked engagement with the carriage forward edge 114. This results in easier door closing effort, by virtue of rotating the swing-arm 50 counter-clockwise only about 90 degrees to its FIG. 6 position, rather than rotating the swing-arm to its intermediate-open carriage engaging position of FIG. 7.

Figure 3:
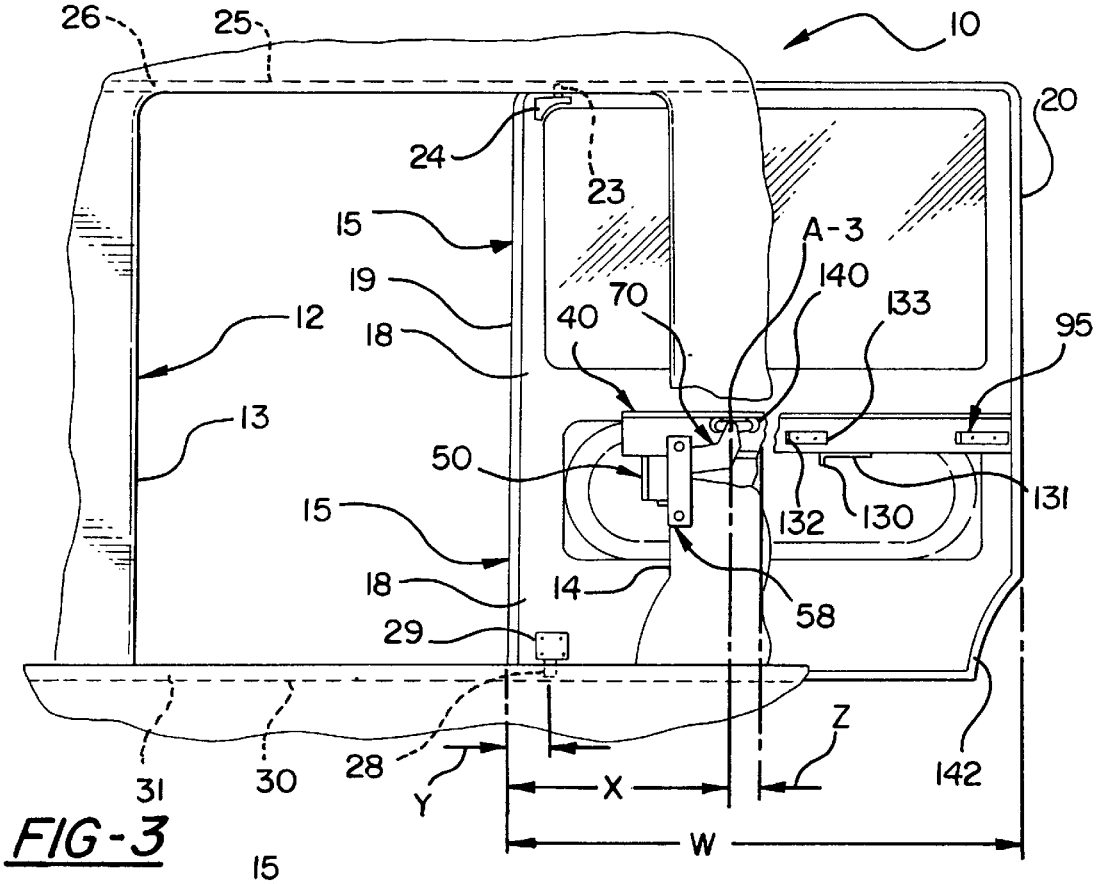
FIG. 3 is a view similar to FIG. 2 showing the sliding door in its full rearward open position.

Referring to FIG. 3, it will be seen that the sliding door of 15 of the disclosed embodiment has an overall width "W" of about 1285 mm. With the door in its full-open position, the swing-arm 50 locates the transverse axis "A-3" of the twin roller carriage hanger pin 82 at a dimension "X" of about 512 mm. Each of the upper 23 and lower 28 guide rollers is spaced a dimension "Y" of about 100 mm from the door leading edge. The center of gravity 140 of the door is located a dimension "Z" of about 78 mm aft of the support pin axis "A-3". It will be noted that the door center of gravity 140 is closer, by about 50 mm, to the door's forward edge 19 than its front to rear midpoint, because of the door's radiused-out portion 142.

It will be appreciated that because of the swing-arm 50 and roller 70 supporting arrangement for the middle track 40, the axis "A-3", which defines the door weight line of action, is about 78 mm, i.e. about three inches, from the door's center of gravity. Thus, the weight of the door 15 is transferred by the support pin closely adjacent center of gravity 140. Further, the supporting arrangement provides a large longitudinal offset dimension "X" between the forward upper 23 and lower 28 guide rollers and the transverse support pin load axis "A-3" of the twin rollers 83 and 84 load. In the disclosed embodiment the offset dimension "X" is about 412 mm, i.e. almost one-third of the door width, thereby insuring that the door remains stable even in its full-open position.

Referring to FIG. 5, it will be appreciated that the trough-plate shape of the swing arm results in the bight section 51 being offset inboard from a vertical plane that includes the vertical hinge pin axes "A-1" and "A-2". As seen in FIG. 7, the bight section offset, together with the outboard diverging front 52 and rear 53 legs, provides a clearance space 146 which enables a portion of the aft pillar 14 and body side panel 11 stricture to be received in the space 146, thereby allowing the swing-arm to be rotated through its obtuse angle "C" of about 124 degrees. Further, the space 146 provides room to package portions of the carriage 70 therein.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An arrangement for mounting a sliding door to a vehicle body in combination with the vehicle body, the sliding door being movable between a fully open position in which the door is oriented substantially parallel to a side of the vehicle body and a closed position in which the sliding door closes an opening in the vehicle body, the arrangement comprising:

a track mounted longitudinally on an inner side of the sliding door, said track mounted intermediate to an upper and a lower edge of the sliding door;

a carriage support arrangement carried by the sliding door and in slidable communication with said track; and a swing arm including a first end attached to said carriage support arrangement for pivotal movement about a first axis and a second end attached to the vehicle body for pivotal movement about a second axis, said swing arm adapted for rotation about said second axis between first and second positions whereat said first position the sliding door is in the closed position and said first pivot axis is located fore of said second pivot axis and whereat said second position the sliding door is in an intermediate position fore of said fully open position and said first pivot axis is located aft of said second pivot axis.

2. The arrangement for mounting a sliding door to a vehicle body of claim 1, wherein said swing arm defines, in the first position, a longitudinally extending intermediate section terminating in front and rear outboard diverging legs.

3. The arrangement for mounting a sliding door to a vehicle body of claim 1, wherein said carriage support arrangement includes a roller assembly for transmitting the weight of the sliding door from said track to said swing arm.

4. The arrangement for mounting a sliding door to a vehicle body of claim 1, wherein said swing arm rotates through an obtuse angle between said first and second positions.

5. The arrangement for mounting a sliding door to a vehicle body of claim 1, wherein the sliding door moves from the intermediate position to the fully open position through translation of said carriage support arrangement within said track.

6. The arrangement for mounting a sliding door to a vehicle body of claim 1, further comprising a biasing mechanism for biasing said swing arm toward said second position.

7. The arrangement for mounting a sliding door to a vehicle body of claim 1, further comprising a latching mechanism operative for preventing longitudinal movement of the sliding door relative to the carriage support arrangement when said swing arm is rotated between said first and second positions.

8. A motor vehicle comprising:

a body including a side having a door opening;

a sliding door having an upper edge, a lower edge and an inner side;

an arrangement for mounting said sliding door to a said body so that said sliding door is movable between a fully open position in which said sliding door is oriented substantially parallel to said side of said body and a closed position in which said sliding door closes said door opening in said side, the arrangement comprising:

a track mounted longitudinally on said inner side of said sliding door, said track mounted intermediate to said upper and lower edges of said sliding door;

a carriage support arrangement carried by said sliding door and in slidable communication with said track; and a swing arm including a first end attached to said carriage support arrangement for pivotal movement about a first axis and a second end attached to said body for pivotal movement about a second axis, said swing arm adapted for rotation about said second axis between first and second positions whereat said first position said sliding door is in said closed position and said first pivot axis is located fore of said second pivot axis and whereat said second position said sliding door is in an intermediate position fore of said fully open position and said first pivot axis is located aft of said second pivot axis.

9. The motor vehicle of claim 8, wherein said swing arm defines, in the first position, a longitudinally extending intermediate section terminating in front and rear outboard diverging legs.

10. The motor vehicle of claim 8, wherein said carriage support arrangement includes a roller assembly for transmitting the weight of said sliding door from said track to said swing arm.

11. The motor vehicle of claim 8, wherein said swing arm rotates through an obtuse angle between said first and second position.

12. The motor vehicle of claim 8, wherein said sliding door moves from said intermediate position to said fully open position through translation of said carriage support arrangement within said track.

13. The motor vehicle of claim 8, further comprising a biasing mechanism for biasing said swing arm toward said second position.

14. The motor vehicle of claim 8, further comprising a latching mechanism operative for preventing longitudinal movement of said sliding door relative to the carriage support arrangement when said swing arm is rotated between said first and second positions.

15. An arrangement for mounting a sliding door to a vehicle body in combination with the vehicle body, the vehicle body having a side with a door opening, the arrangement comprising:

a track mounted longitudinally on an inner side of the sliding door, said track mounted intermediate to an upper and a lower edge of the sliding door;

a carriage support arrangement carried by the sliding door and in slidable communication with said track; and a swing arm including a first end attached to said carriage support arrangement for pivotal movement about a first axis and a second end attached to said vehicle body for pivotal movement about a second axis;

said arrangement operative in a door closed mode in which the sliding door is in a closed position closing the door opening and said first axis is located fore of said second axis;

said arrangement operative in a door fully open mode in which the sliding door is in a fully open position longitudinally displaced from the door opening and said first axis is located aft of said second axis.

16. The arrangement for mounting a sliding door to a vehicle body of claim 15, wherein said arrangement is operative in an intermediate open mode when the sliding door is longitudinally translated forward from said fully open position.

17. The arrangement for mounting a sliding door to a vehicle body of claim 15, wherein the sliding door moves to said fully open position through translation of said carriage support arrangement within said track.

18. The arrangement for mounting a sliding door to a vehicle body of claim 15, wherein said swing arm defines, when said arrangement is in said door closed mode, a longitudinally extending intermediate section terminating in front and rear outboard diverging legs.

19. The arrangement for mounting a sliding door to a vehicle body of claim 18, wherein said swing arm rotates through an obtuse angle as said arrangement is moved between said closed mode and said intermediate open mode.

20. The arrangement for mounting a sliding door to a vehicle body of claim 19, further comprising a latching mechanism operative for preventing longitudinal movement of the sliding door relative to the carriage support arrangement when said swing arm is rotated through said obtuse angle.

* * * * *